US005548103A

United States Patent [19]

Morita

[11] Patent Number: 5,548,103

[45] Date of Patent: Aug. 20, 1996

[54] MICROWAVE OVEN WITH HEATING UNEVENNESS PREVENTING FUNCTION

[75] Inventor: Mika Morita, Nagoya, Japan

[73] Assignee: Kabushiki Kaisha Toshiba, Kawasaki, Japan

[21] Appl. No.: 379,156

[22] Filed: Jan. 27, 1995

[30] Foreign Application Priority Data

Jan. 28, 1994 [JP] Japan ..... 6-008513

[51] Int. Cl.[6] ..... H05B 6/68

[52] U.S. Cl. ..... 219/703; 219/708; 219/718; 99/325

[58] Field of Search ..... 219/703, 718, 219/715, 716, 708; 99/DIG. 14, 325

[56] References Cited

U.S. PATENT DOCUMENTS 4,190,756 2/1980 Foerstner ..... 219/718
4,453,066 6/1984 Mori ..... 219/703
4,507,531 3/1985 Teich et al. ..... 219/718
4,705,926 11/1987 Sakai et al. ..... 219/703
4,724,291 2/1988 Inumada ..... 219/718

*Primary Examiner*—Philip H. Leung
*Attorney, Agent, or Firm*—Cushman Darby & Cushman, L.L.P.

[57] ABSTRACT

A microwave oven includes a control section storing a long period pattern in which each period of on and off times is relatively long and a short period pattern in which each period is shorter than that in the long period pattern. A magnetron is controlled to be turned on and off in accordance with either period pattern. The short period pattern is selected when frozen food is thawed. Since the on time in each period of the short period pattern is short, the frozen food is exposed to microwave for a shortened period of time. As a result, unevenness in the thawing is prevented.

11 Claims, 15 Drawing Sheets

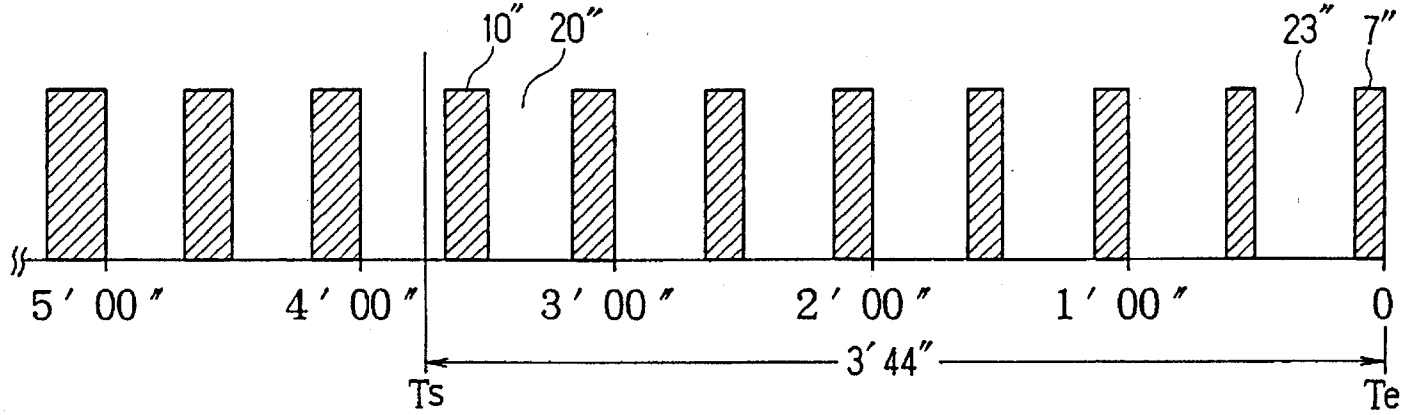
FIG. 6A P a
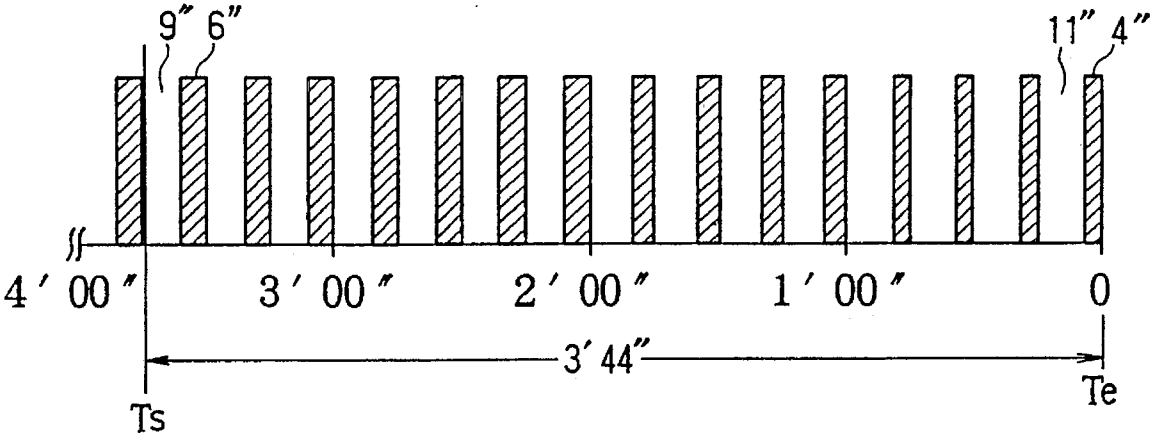
FIG. 6B P b

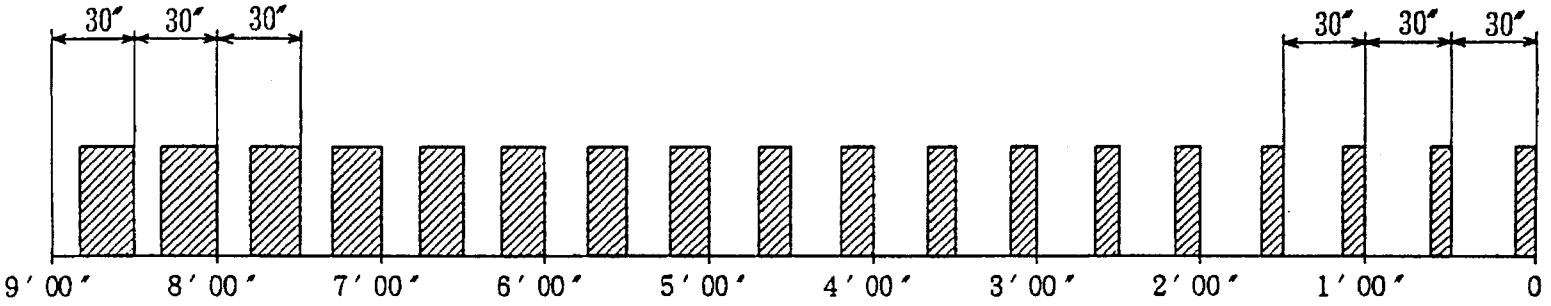
FIG. 7A Pc
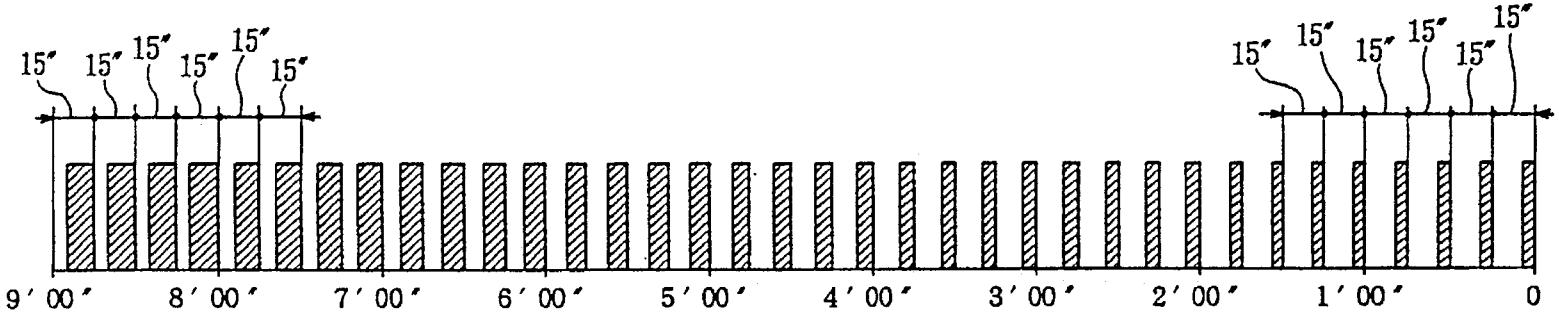
FIG. 7B Pd

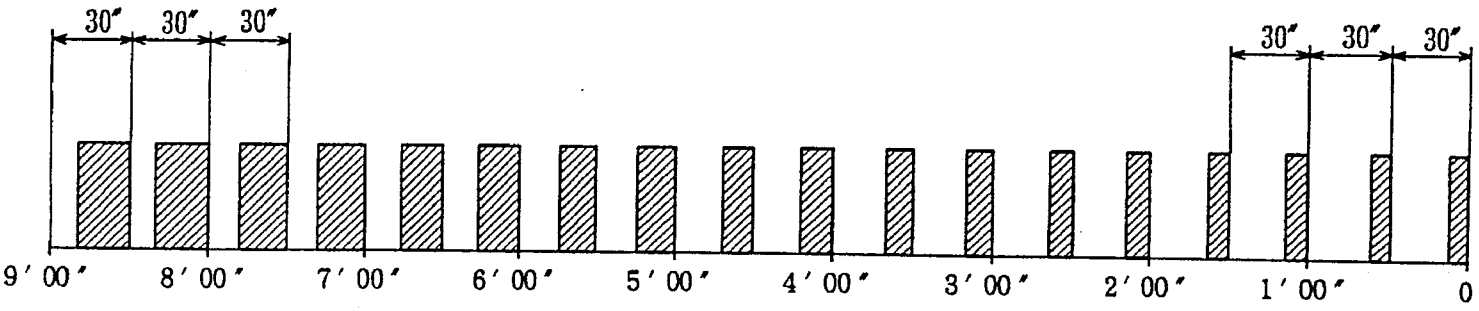
FIG. 9A Pe
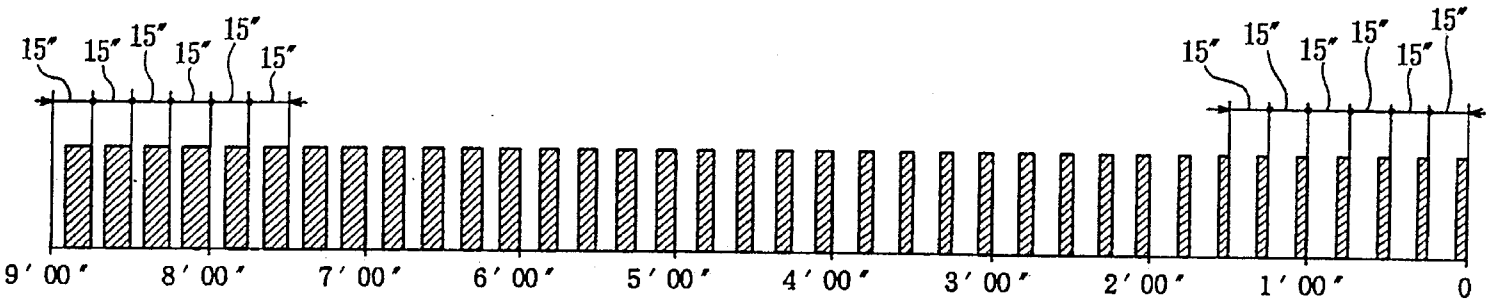
FIG. 9B Pf

CONTRASTIVE PATTERN

EMBODIMENT

CONTRASTIVE PATTERN

EMBODIMENT

MICROWAVE OVEN WITH HEATING UNEVENNESS PREVENTING FUNCTION

BACKGROUND OF THE INVENTION

1. Field of the Invention

This invention relates to a microwave oven comprising a magnetron, and more particularly to such a microwave oven having a function of thawing frozen food.

2. Description of the Prior Art

The prior art has provided microwave ovens with a function of thawing frozen food. In these microwave ovens, a magnetron is provided for generating microwave which is radiated onto the food for heating the same. The magnetron is on-off controlled for control of its output. The prior art microwave ovens have only one kind of on-off control pattern for the thawing operation. Accordingly, a heating period is varied in accordance with the weight and type of the frozen food and desired heating degree.

It is usually desirable that the food is uniformly heated in its entirety. In the above-described prior art microwave ovens, however, part of the frozen food is heated more intensely than the other part thereof, whereupon the frozen food is unevenly heated or unevenness in the heating occurs in the food.

SUMMARY OF THE INVENTION

Therefore, an object of the present invention is to provide a microwave oven wherein the frozen food can be thawed without occurrence of unevenness in the heating.

To achieve this and other objects, the present invention provides a microwave oven comprising a magnetron for delivering microwave for heating frozen food. Control means is electrically connected to the magnetron for controlling operation of the magnetron. Condition input means is electrically connected to the control means for inputting data conditioning a heating control to the control means. Storage means is electrically connected to the control means for storing data of two kinds of on-off patterns for on-off controlling the magnetron. Either one of the two kinds of on-of patterns is selected for a single thawing step executed during a period from a start to a completion of a thawing operation. One of the two kinds is a long period pattern wherein each period that is a total of an on-time and an off-time is relatively long and, the other kind is a short period pattern wherein each one period which is a total of the on-time and the off-time is shorter than that of the long period pattern. Selecting means is electrically connected to the control means for selecting the short period pattern when the conditioning data input from the condition input means to the control means indicates that unevenness in the heating tends to occur in the frozen food, during the thawing of the frozen food, so that the control means controls the magnetron in accordance with the selected short period pattern. The selecting means otherwise selects the long period pattern so that the control means controls the magnetron in accordance with the selected long period pattern.

The efficiency of dielectric heating by the microwave becomes higher in a part of the food containing a larger amount of liquid or moisture than the other part thereof. When the frozen food is heated by the microwave, a part of the food is dissolved into water with progress of the thawing. The rate of temperature rise is higher in the part containing the water than in the other part of the food, which results in occurrence of unevenness in the heating.

According to the microwave oven of the present invention, the selecting means selects the short period pattern when the control means is provided with the data indicating that unevenness in the heating tends to occur, so that the magnetron is on-off controlled in accordance with the selected short period pattern. Since the period of the on-time and off-time is relatively short in the short period pattern, the continuous on time in one cycle is also short. Consequently, since the food is exposed to the microwave for a shorter continuous period of time, unevenness in the heating can be reduced during the thawing of the frozen food by means of the microwave and accordingly, uniform heating can be expected.

The unevenness in the heating tends to occur when a relatively small amount of frozen food is thawed. To cope with this problem, the condition input means may comprise food weight specifying means for specifying the weight of the frozen food, such as a weight input switch or weight detecting device. In this arrangement, the selecting means selects the short period pattern when the weight of the frozen food specified by the food weight specifying means is at a predetermined value or below.

The condition input means may comprise heating degree designating means for designating the degree of strength of the heating for the frozen food among modes at least including an INTENSE mode after the same has been thawed. The selecting means selects the short period pattern when the INTENSE heating mode has been designated by the heating degree designating means.

The condition input means may comprise food type specifying means for specifying a type of the frozen food. In this arrangement, the selecting means selects either the long or short period pattern in accordance with the type of the frozen food specified by the food type specifying means. Occurrence of the unevenness in the heating can be prevented, particularly, in the food type in which the unevenness in the heating tends to occur in the thawing.

The condition input means may comprise heating period specifying means for specifying a heating period for the frozen food. In this case, the selecting means selects the short period pattern when the heating period specified by the heating period specifying means is at a predetermined value or below.

The short period pattern preferably includes at least an initial one cycle of a continuous on mode, so that the total heating period can be shortened.

BRIEF DESCRIPTION OF THE DRAWINGS

Other objects, features and advantages of the present invention will become clear upon reviewing the following description of preferred embodiments thereof, made with reference to the accompanying drawings, in which:

FIGS. 6A and 6B are graphs showing, in more detail, on-off control patterns corresponding to specific remaining periods in the on-off control patterns shown in FIGS. 4A and 4B, respectively;

FIGS. 7A and 7B are graphs showing an on-off control pattern employed in a second embodiment of a microwave oven in accordance with the present invention;

FIGS. 9A and 9B are graphs showing an on-off control pattern employed in a third embodiment of a microwave oven in accordance with the present invention;

DESCRIPTION OF THE PREFERRED EMBODIMENTS

Figure 1:
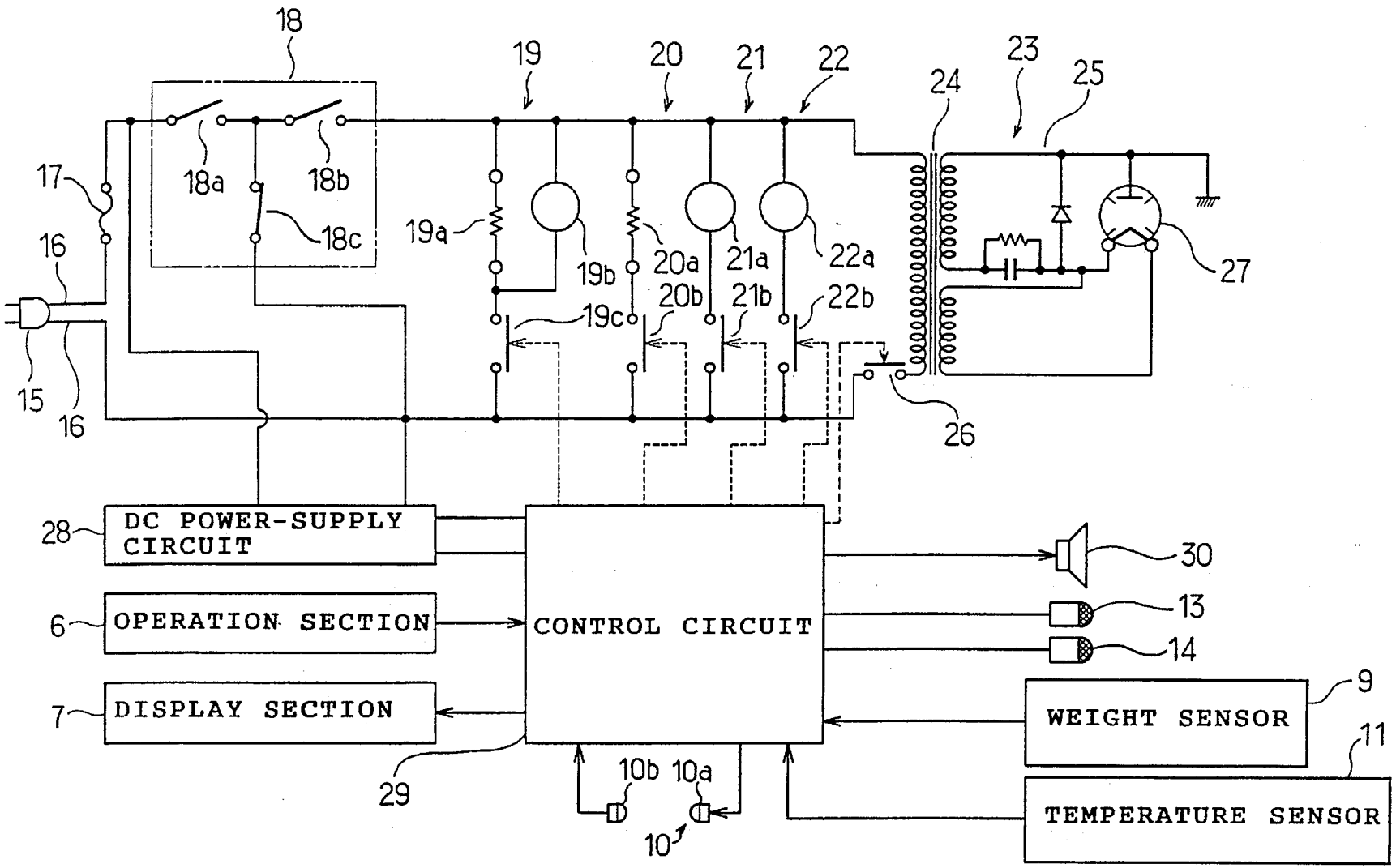
FIG. 1 is an electrical circuit diagram showing an electrical arrangement of a first embodiment of a microwave oven in accordance with the present invention.

A first embodiment of the present invention will be described with reference to FIGS. 1 to 6. Referring first to FIG. 2, a microwave oven of the first embodiment is shown. The microwave oven comprises a body 1 defining therein a heating chamber 3. The heating chamber 3 has a front opening closed and opened by a door 2. A turntable 4 is rotatably mounted on the bottom of the heating chamber 3. An operation panel 5 is mounted on the front of the body 1. The operation panel 5 includes an operation section 6 having a plurality of operation keys and a display section 7. The operation keys of the operation section 6 include a thawing key 6*a*, a heating level setting key 6*b* serving as heating degree designating means setting the doneness of food among INTENSE, STANDARD, LIGHT, a start key 6*c* and a MEAT/FISH designating key 6*d* serving as specifying means for specifying the type of a frozen food.

Figure 3:
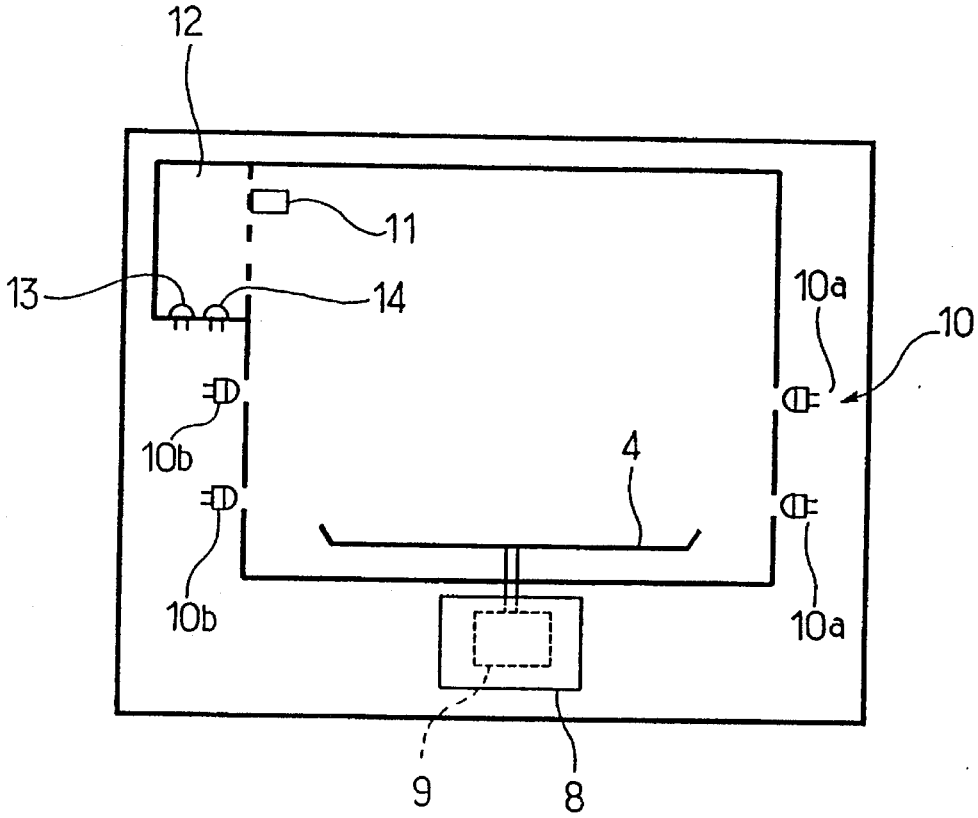
FIG. 3 is a schematic longitudinal sectional front view of the microwave oven.
Figure 4:
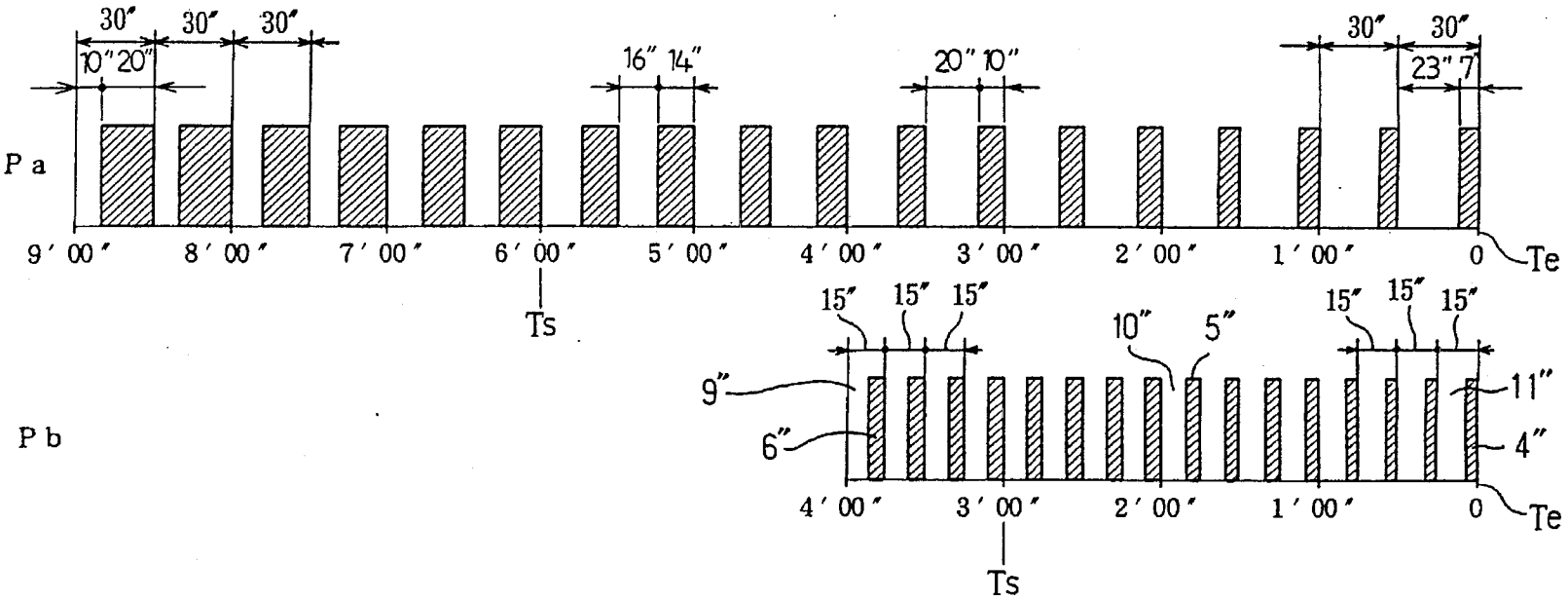
FIGS. 4A and 4B are graphs showing on-off control patterns for on-off control of a magnetron of the microwave oven.

Referring to FIG. 3, arrangement of various sensors is shown. The turntable 4 is rotated by a drive mechanism 8 provided below the heating chamber 3. The turntable 4 is also received by a weight sensor 9 integral with the drive mechanism 8 and serving as weight detecting means. Two photosensors 10 are provided on the side walls of the heating chamber 3. Each photosensor 10 comprises a light emitting element 10*a* mounted on the right-hand side wall and a light detecting element 10*b* mounted on the left-hand side wall so as to be opposite to the light emitting element 10*a*, as viewed in FIG. 3. An alcohol sensor 13 and a gas sensor 14 are provided in an exhaust path 12 communicating with the heating chamber 3. The above-described heating degree designating means and the food type specifying means and the weight detecting means compose condition input means for inputting data conditioning a heating control, as will be described later.

Figure 2:
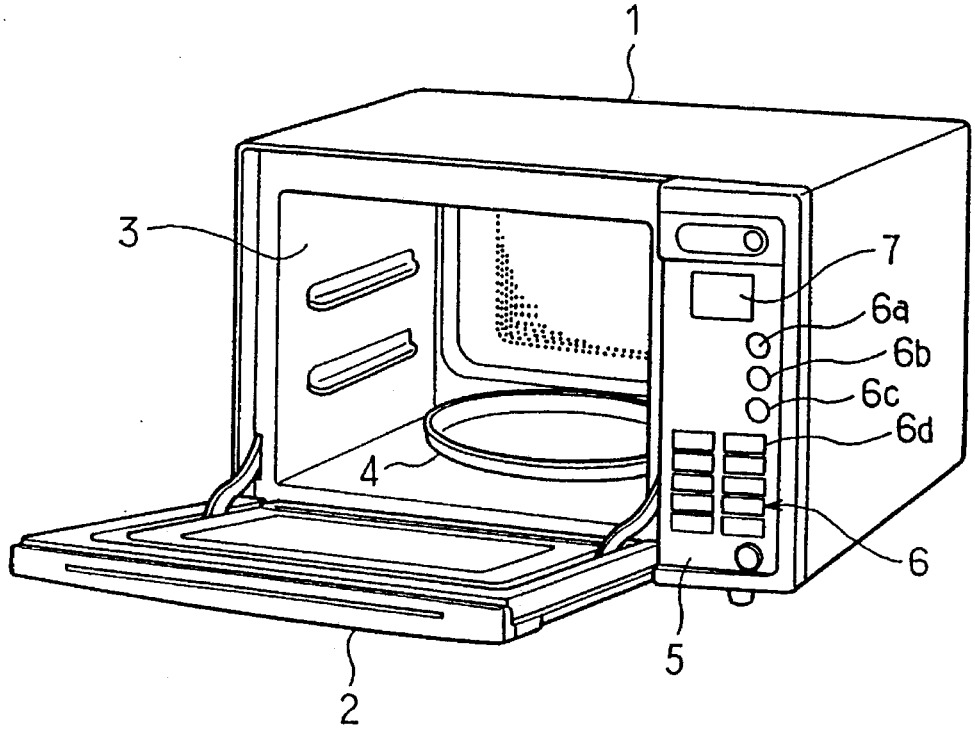
FIG. 2 is a perspective view of the microwave oven.

Referring now to FIG. 1, a fuse 17 and an oscillation shutdown device 18 are connected to an AC power supply line 16*b* extending from a power-supply plug 15. The oscillation shutdown device 18 comprises first to third door switches 18*a* to 18*c*. When the heating chamber 3 is closed by the door 2, the first and second door switches 18*a* and 18*b* are closed while the third door switch 18*c* is opened.

An oven control circuit 19, a grill control circuit 20, a blowing control circuit 21 and a turntable control circuit 22 are connected between the AC power-supply lines 16*a* and 16*b*. The oven control circuit 19 comprises a parallel circuit of an oven heater 19*a* and an oven fan 19*b* and an oven relay switch 19*c* connected in series to the parallel circuit. The grill control circuit 20 comprises a series circuit of a grill heater 20*a* and a grill relay switch 20*b*. The blowing control circuit 21 comprises a series circuit of a blowing fan 21*a* and a blowing relay switch 21*b*. The turntable control circuit 22 comprises a series circuit of a turntable motor 22*a* composing the above-described drive mechanism 8 and a motor relay switch 22*b*.

A magnetron drive circuit 23 comprises a step-up transformer 24 and a high voltage rectifier circuit 25. The primary side of the step-up transformer 24 is connected to the AC power-supply line 16*a* through a relay switch 26. The magnetron drive circuit 23 supplies a high voltage to a magnetron 27 serving as heating means. The magnetron 27 radiates microwave through a waveguide (not shown) into the heating chamber 3.

A DC power-supply circuit 28 is connected to the AC power-supply lines 16*a* and 16*b* for supplying a DC voltage to a control circuit 29. The control circuit 29 comprises a microcomputer, analog-to-digital (A/D) converters and relay circuits and serves as selecting means and control means as will be described later. Each key of the operation section 6 generates an output signal when operated. The output signal generated by each key is supplied to the control circuit 29. The display section 7 displays the contents in accordance with a display command supplied thereto from the control circuit 29. A buzzer 30 is activated in response to a command supplied thereto from the control circuit 29. The alcohol sensor 13 generally detects alcohol contained in exhaust gas exhausted from the heating chamber 3. The gas sensor 14 generally detects steam contained in the exhaust gas from the heating chamber 3. Each of these sensors 13 and 14 varies its resistance values in accordance with concentration of the gas to be detected and delivers to the control circuit 29 a voltage signal indicative of the varied resistance value. The weight sensor 9 detects the weight of food placed on the turntable 4 and delivers to the control circuit 29 a signal indicative of the detected weight of the food. The temperature sensor 11 detects the temperature in the heating chamber 3 and delivers to the control circuit 29 a signal indicative of the detected temperature.

The control circuit 29 turns the relay switches 19*c*, 20*b*, 21*b*, 22*b* and 26 on and off and drives the magnetron drive circuit 23 depending upon one or more operated keys of the operation section 6, thereby executing a heating operation. The control circuit 29 completes the heating operation upon lapse of a heating period of time or in response to detection by the sensors 9, 11, 13 and 14. A read-only-memory (ROM) provided in the microcomputer or an external storage each of which serves as storage means stores data of a plurality of patterns of on and off periods for on-off controlling the magnetron 27 or the relay switch 26 serving as on-off control means. FIGS. 4A and 4B show such patterns. As shown, each one period of a total of an on-time and an off-time is relatively long in pattern Pa while each one period of a total of the on-time and the off-time is relatively short in pattern Pb. Each one period is set at 30 seconds in the long period pattern Pa while it is set at 15 seconds in the short period pattern Pb. In each of the long and short period patterns, the on-time and the off-time are varied in every time zone of the heating period so that a duty cycle of each pattern is gradually decreased as shown by the following TABLES 1 and 2.

TABLE 1

| Long period pattern Pa | | | |
|---|---|---|---|
| Remaining period $T_r$ (min.) | On-time (sec.) | Off-time (sec.) | Output (W) |
| $8 \leqq T_r < 9$ | 20 | 10 | 333 |
| $7 \leqq T_r < 8$ | 18 | 12 | 300 |
| $6 \leqq T_r < 7$ | 16 | 14 | 267 |
| $5 \leqq T_r < 6$ | 14 | 16 | 233 |
| $4 \leqq T_r < 5$ | 12 | 18 | 200 |
| $3 \leqq T_r < 4$ | 10 | 20 | 167 |
| $2 \leqq T_r < 3$ | 9 | 21 | 150 |
| $1 \leqq T_r < 2$ | 8 | 22 | 133 |
| $0 \leqq T_r < 1$ | 7 | 23 | 117 |

TABLE 2

| Short period pattern Pb | | | |
|---|---|---|---|
| Remaining period $T_r$ (min.) | On-time (sec.) | Off-time (sec.) | Output (W) |
| $8 \leqq T_r < 9$ | — | — | — |
| $7 \leqq T_r < 8$ | — | — | — |
| $6 \leqq T_r < 7$ | — | — | — |
| $5 \leqq T_r < 6$ | — | — | — |
| $4 \leqq T_r < 5$ | — | — | — |
| $3 \leqq T_r < 4$ | 6 | 9 | 200 |
| $2 \leqq T_r < 3$ | 6 | 9 | 200 |
| $1 \leqq T_r < 2$ | 5 | 10 | 167 |
| $0 \leqq T_r < 1$ | 4 | 11 | 133 |

Each of the patterns Pa and Pb has a time length corresponding to a previously determined maximum heating period, and the maximum heating periods of the patterns Pa and Pb are set at 9 and 4 minutes respectively, for example. Either one of the two kinds of on-off patterns Pa and Pb is selected in a single thawing step executed during a period from a start to a completion of a thawing operation, as will be described later. In each of FIGS. 4A and 4B, reference symbol $T_s$ designates a heating start time when a heating period is set. Reference symbol $T_e$ designates a heating termination time. The time zone between the heating start time $T_s$ and the heating termination time $T_e$ corresponds to the set heating period and is referred to as "remaining period."

As obvious from TABLES 1 and 2, the on-time and the off-time are varied in every one minute in the heating period zone, whereby the calorific power is high at an initial stage and is then gradually reduced such that unevenness in the heating is lowered.

Figure 5:
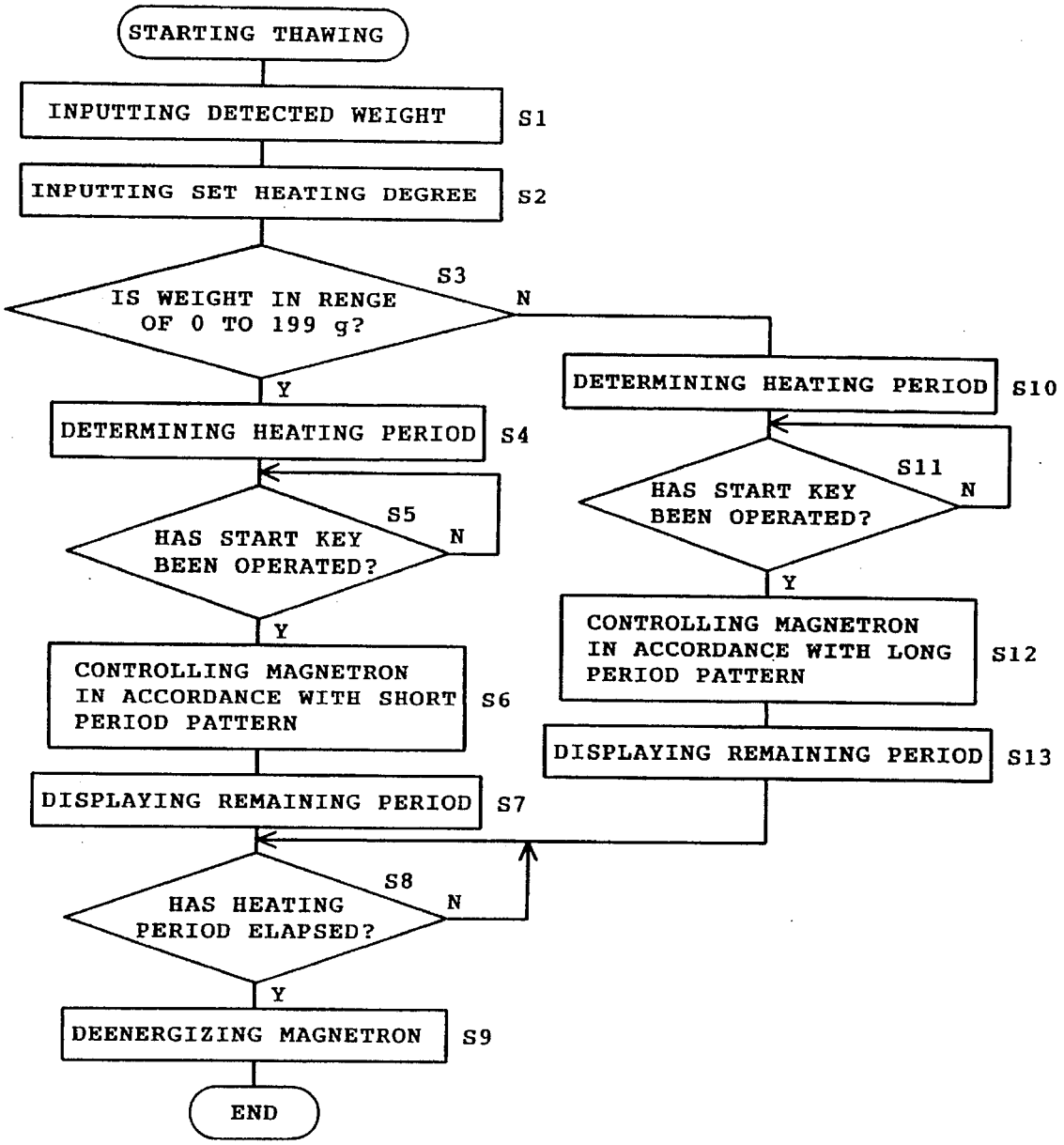
FIG. 5 is a flowchart showing a manner of controlling the magnetron.

The operation of the microwave oven will now be described. FIG. 5 is a flowchart showing the operation of the control circuit 29 serving both as selecting and control means in the case where the thawing key 6*a* of the operation section 6 has been depressed. The control circuit 29 inputs the signal delivered from the weight sensor 9 to detect the weight of the food at step S1. The control circuit 29 then inputs the contents set with the heating level setting key 6*b* serving as the heating degree designating means or the degree of heating designated by the user at step S2. At step S3, the control circuit 29 determines as to whether or not the detected weight of the food is at a reference value or below or as to whether or not the detected weight is within a reference range of 0 to 199 gram. When determining that the detected weight is within the reference range, the control circuit 29 advances to step S4 where a heating period is determined. The heating period is determined on the basis of the detected weight and the set heating degree, as shown in the following TABLE 3:

TABLE 3

| Determination of the heating period | | | |
|---|---|---|---|
| Set weight W (g) | LIGHT (sec.) | STANDARD (sec.) | INTENSE (sec.) |
| 10 to 50 | STANDARD value × 0.9 | 110 | 120 |
| 60 to 300 | STANDARD value × 0.9 | T = 0.6W + 90 | T = 0.8W + 80 |
| 310 to 600 | STANDARD value × 0.9 | T = 0.5W + 120 | T = 0.5W + 170 |

For example, the heating period T is determined to be 110 seconds when the detected weight value is 45 gram and the degree of heating or the doneness setting is STANDARD. When the doneness setting is LIGHT with the same detected weight value, the heating period T is determined by multiplying the heating period of STANDARD or 110 seconds by a factor of 0.9. Furthermore, when the doneness setting is INTENSE with the same detected weight value, the heating period T is determined to be 120 seconds.

Furthermore, the heating period T is determined by the equation, T=0.6×W+90, when the detected weight value is 100 gram and the doneness setting is STANDARD. When the doneness setting is LIGHT with the same detected weight value, the heating period T is determined by multiplying the heating period of STANDARD or T=0.6×W+90 by the factor of 0.9. Additionally, the heating period T is determined by the equation, T=0.8×W+80, when the doneness setting is INTENSE with the same detected weight value.

Upon operation of the start key 6*c* at step S5 subsequently to step S4, the control circuit 29 advances to step S6 where the short period pattern Pb as shown in FIG. 4B is selected so that the relay switch 26 and accordingly the magnetron 27 are on-off controlled in accordance with the selected short period pattern Pb. For example, when the weight of the frozen food is 180 gram and the doneness setting is INTENSE, the remaining period of the heating period T is determined to be 224 seconds or 3 minutes and 44 seconds, as shown in TABLE 3. The operation of the magnetron 27 is initiated at time $T_s$ which time is 224 seconds before the termination time $T_e$ of the pattern Pb, as shown in FIG. 6B. The frozen food is heated in the period of 15 seconds in which the magnetron 27 is repeatedly turned on for 6 seconds and off for 9 seconds alternately. However, the on-off duty cycle is gradually decreased as shown in TABLE 2.

Subsequently, the control circuit 29 advances to step S7 where the remaining period is sequentially displayed on the display section 7. Upon lapse of the determined heating period T at step S8, the control circuit 29 turns the relay switch 26 off so that the magnetron 27 is deenergized at step S9, thereby completing the heating operation.

When the detected weight value is not within the range of 0 to 199 gram at step S3, the control circuit 29 advances to step S10 where the heating period is determined in the same manner as at step S4. Upon operation of the start key 6c at step S11, the control circuit 29 advances to step S12, selecting the long period pattern Pa (see FIGS. 4A and 6A) so that the relay switch 26 and accordingly the magnetron 27 are on-off controlled in accordance with the pattern Pa. The control circuit 29 then advances to step S13 where the sequentially changing remaining period T is displayed on the display section 7. The control circuit 29 thereafter advances to step S8.

Unevenness in the heating tends to occur when the frozen food is relatively small or when the weight of the food is at the reference value or below or within the range of 0 to 199 gram. The reason for this tendency will be described. The microwave is supplied into the heating chamber 3 upon drive of the magnetron 27. When a bulky frozen food is accommodated in the heating chamber 3, the supplied microwave immediately impinges on the frozen food to be absorbed thereinto. Accordingly, the bulky frozen food is thawed with little unevenness in the heating. However, when the frozen food is small, a space unoccupied by the food in the heating chamber is increased. Consequently, since the number of occasions for the microwave to reflect on the inner walls of the heating chamber 3 is increased, the microwave passes through the central space in the heating chamber 3 with high probability. Taking it in consideration that the frozen food is generally placed in the central space in the heating chamber 3, the microwave would densely impinge on the frozen food. As the result of the dense impingement, part of the frozen food would be melted into water faster than the other part. Since the efficiency of dielectric heating when water is heated by the microwave is relatively high, the rate of temperature rise is higher in the part of the water than in the other part of the food, which would result in occurrence of unevenness in the heating. The unevenness in the heating actually occurs when the frozen food is continuously subjected to the microwave for a long period of time.

According to the above-described embodiment, however, the period of the on-time and the off-time for the magnetron 27 has a plurality of patterns. When the set conditions tends to result in the occurrence of unevenness in the heating or when the weight of the frozen food is at a predetermined value or below, the short period pattern Pb is selected so that the magnetron 27 is controlled in accordance with the pattern Pb. Consequently, since the on-time of the magnetron 27 is shortened, the occurrence of the unevenness in the heating can be prevented. On the other hand, when the set conditions do not tend to result in the unevenness in the heating or when the weight of the frozen food exceeds the predetermined value, the long period pattern Pa is selected. Accordingly, when the relay switch 26 is employed as the means for on-off controlling the magnetron 27 as in the foregoing embodiment, the number of times of the switching operation of the relay switch 26 can be reduced. Consequently, a life period of the relay switch 26 can be increased as compared with the arrangement in which the on and off periods are unconditionally shortened.

In the foregoing embodiment, particularly, the weight sensor 9 automatically detects the weight of the frozen food, and the short period pattern is automatically selected when the detected weight is at the reference value or below or when it is in the predetermined range of 0 to 199 gram. Thus, the on-off control pattern can automatically be selected in accordance with the detected weight of the frozen food, which provides convenience in the use of the microwave oven.

The short period pattern Pb is selected when the weight of the frozen food is at the predetermined value or below and the doneness setting is INTENSE. Consequently, the occurrence of the unevenness in the heating can be prevented on the basis of the weight of the frozen food and the doneness setting.

The period of the short period pattern Pb is set to be one half of that of the long period pattern Pa. The period patterns can be readily formed when a microcomputer is employed for that purpose as in the foregoing embodiment. Alternatively, the short period pattern may be set to be 1/n of the period of the long period pattern where n is a positive integer.

The on-time in each period of each period pattern is set to be gradually reduced, so that the output of the magnetron is gradually decreased. This also provides reduction in the occurrence of unevenness in the heating.

Figure 8:
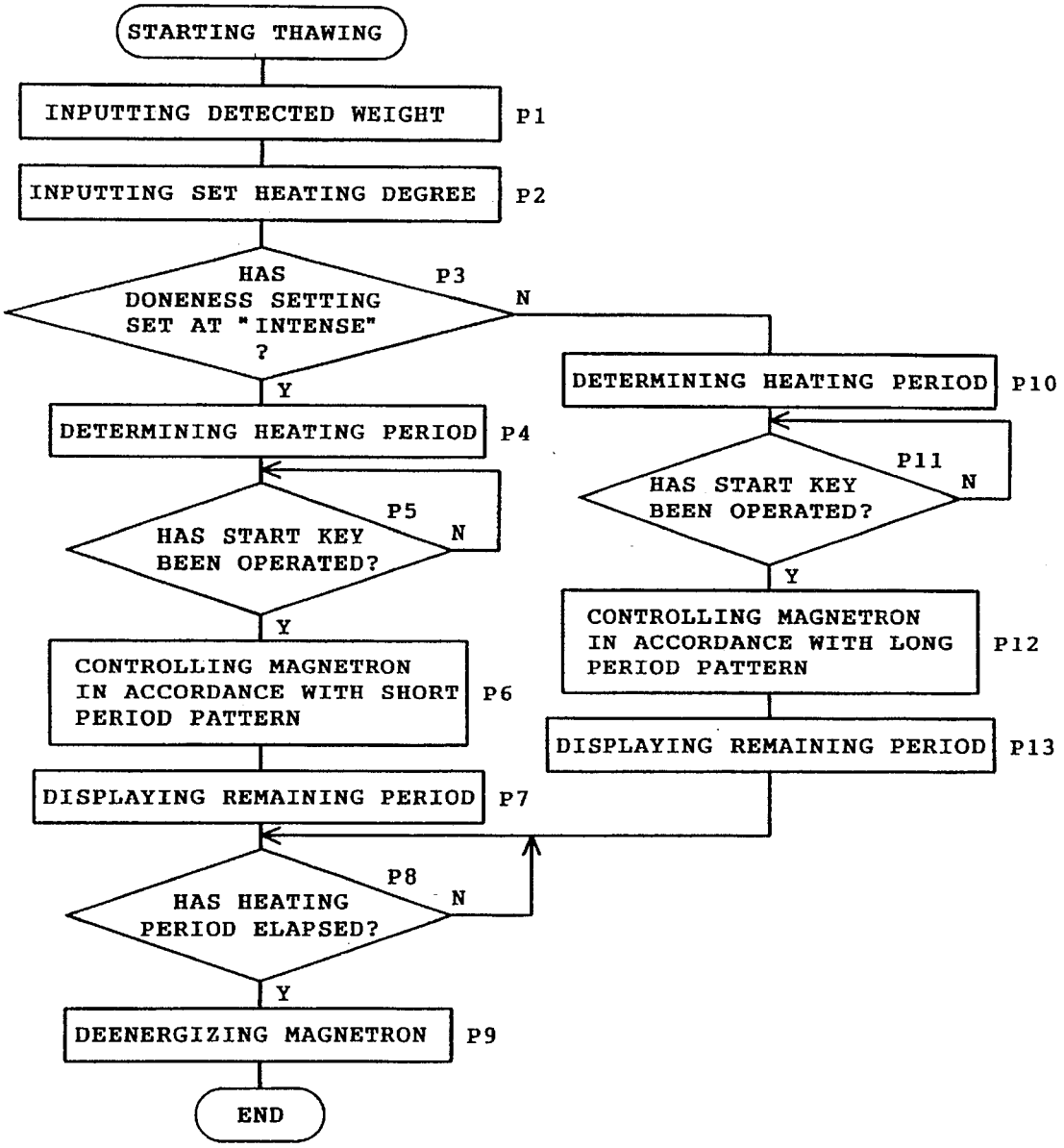
FIG. 8 is a flowchart showing a manner of controlling the magnetron in the second embodiment.

FIGS. 7A, 7B and 8 illustrate a second embodiment of the present invention. The microwave oven of the second embodiment is provided with the on-off period patterns one of which is selected on the basis of the doneness setting. More specifically, FIGS. 7A and 7B show long and short period patterns Pc and Pd respectively. The long period pattern Pc is the same as the long period pattern Pa in the foregoing embodiment. Each one period of a total of an on-time and off-time is set at 15 seconds, and the on-time and the off-time are set as shown in the following TABLE 4:

TABLE 4

| Long period pattern Pa | | | |
|---|---|---|---|
| Remaining period $T_r$ (min.) | On-time (sec.) | Off-time (sec.) | Output (W) |
| $8 \leqq T_r < 9$ | 10 | 5 | 333 |
| $7 \leqq T_r < 8$ | 9 | 6 | 300 |
| $6 \leqq T_r < 7$ | 8 | 7 | 267 |
| $5 \leqq T_r < 6$ | 7 | 8 | 233 |
| $4 \leqq T_r < 5$ | 6 | 9 | 200 |
| $3 \leqq T_r < 4$ | 5 | 10 | 167 |
| $2 \leqq T_r < 3$ | 5 | 10 | 167 |
| $1 \leqq T_r < 2$ | 4 | 11 | 133 |
| $0 \leqq T_r < 1$ | 4 | 11 | 133 |

Referring to FIG. 8 illustrating the control manner, the control circuit 29 inputs the signal from weight sensor to detect the weight of the frozen food at step P1. The control circuit 29 then inputs the contents set with the heating level setting key 6b serving as the heating degree designating means or the degree of heating designated by the user at step P2. The control circuit 29 determines as to whether or not the INTENSE mode has been set at step P3. When the INTENSE mode has been set, the control circuit 29 advances to step P4 where the heating period T is determined. The heating period T is determined in the same manner as in the first embodiment.

Upon depression of the start key 6c at step P5 subsequently, the control circuit 29 advances to step P6 where the relay switch 26 is controlled to repeatedly be turned on and off alternately in accordance with the short period pattern Pd. The control circuit 29 then advances to step P7 to sequentially display the remaining period on the display 7. Upon lapse of the determined heating period T at step P8, the relay switch 26 is turned off so that the magnetron 27 is deenergized at step P9, whereby the heating is completed.

When the INTENSE mode has not been set at step P3 or when the STANDARD or LIGHT mode has been set, the control circuit 29 executes steps P10 and P11 containing the same control contents as those in steps P4 and P5 respectively. The magnetron 27 is controlled in accordance with the long period pattern Pc when it is determined at step P11 that the start key 6c has been operated. Thereafter, the control circuit 29 advances to the above-described step PS.

According to the second embodiment, the short period pattern Pd is selected when the INTENSE mode has been set. Accordingly, the occurrence of the unevenness in the heating can be prevented when the degree of strength of the heating is high such that the unevenness in the heating tends to occur.

Figure 10:
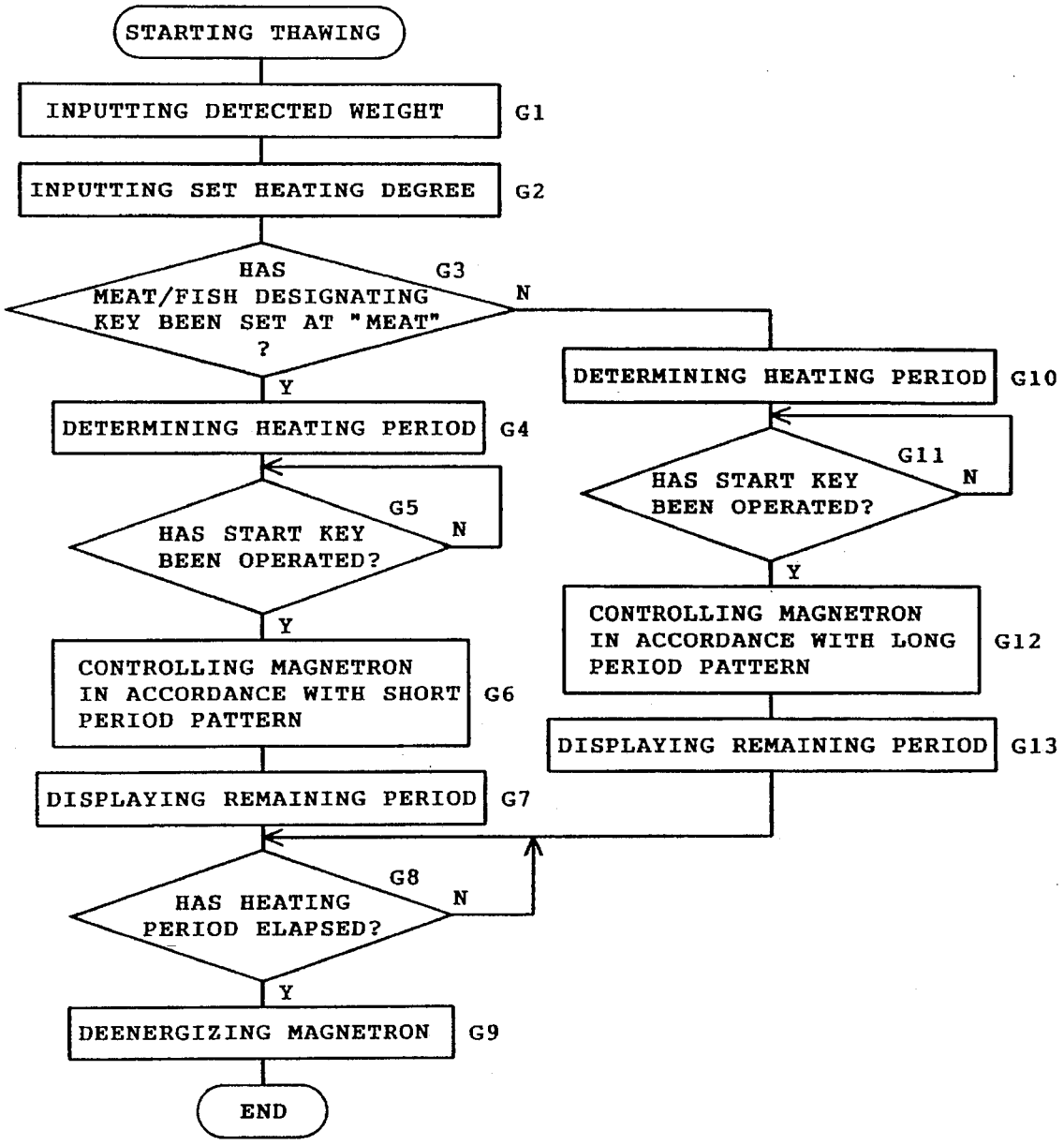
FIG. 10 is a flowchart showing a manner of controlling the magnetron in the third embodiment.

FIGS. 9A, 9B and 10 illustrate a third embodiment of the present invention. The long and short period patterns Pe and Pf in the third embodiment are the same as those in the second embodiment, as shown in FIGS. 9A and 9B, respectively. The control circuit 29 determines as to whether or not meat has been designated with the MEAT/FISH designating key 6c, at step G3 in FIG. 10. One of the period patterns is selected on the basis of the determination at step G3. More specifically, when determining at step G3 that meat has been designated, the control circuit 29 selects the short period pattern Pf and controls the magnetron 27 in accordance with the selected short period pattern Pf at step G6. On the other hand, when meat has not been designated or when fish has been designated, the long period pattern Pe is selected and the magnetron 27 is on-off controlled in accordance with the long period pattern Pe at step G12.

According to the third embodiment, one of the period patterns is selected in accordance with the food type of the frozen food. Consequently, the occurrence of the unevenness in the heating can be prevented even when the frozen food to be heated belongs to the food type in which the unevenness in the heating tends to occur. In particular, the short period pattern Pf is effectively selected when the frozen food to be heated is meat. Since meat has an irregular surface as compared with "sashimi" or sliced raw fish or the like, the unevenness in the heating is more likely to occur in the case of meat. In the third embodiment, however, the short period pattern Pf is selected when meat is heated. Consequently, the occurrence of the unevenness in the heating can be prevented when meat is heated.

Figure 11A:
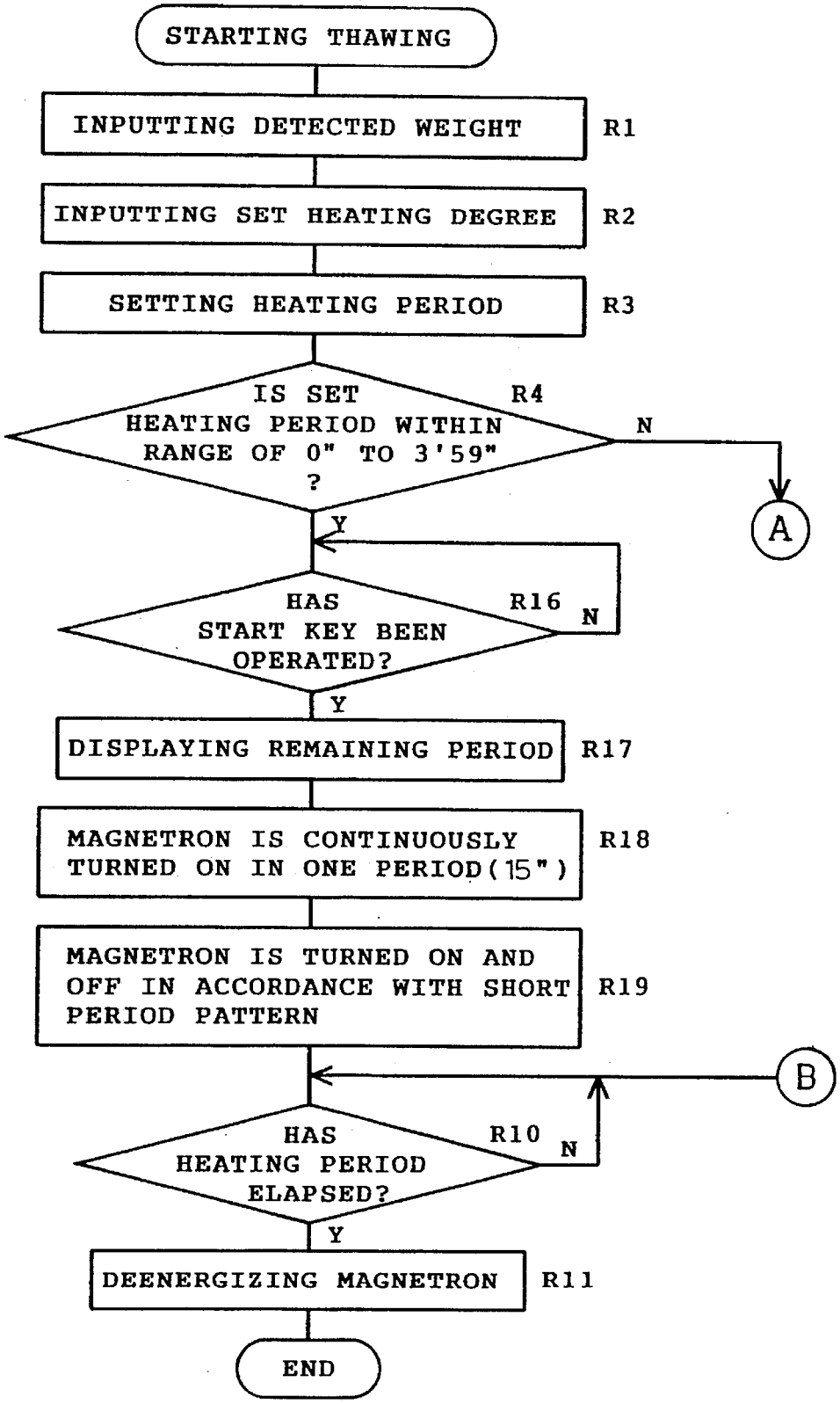
FIGS. 11A and 11B are flowcharts showing a manner of controlling the magnetron in a fourth embodiment.
Figure 11B:
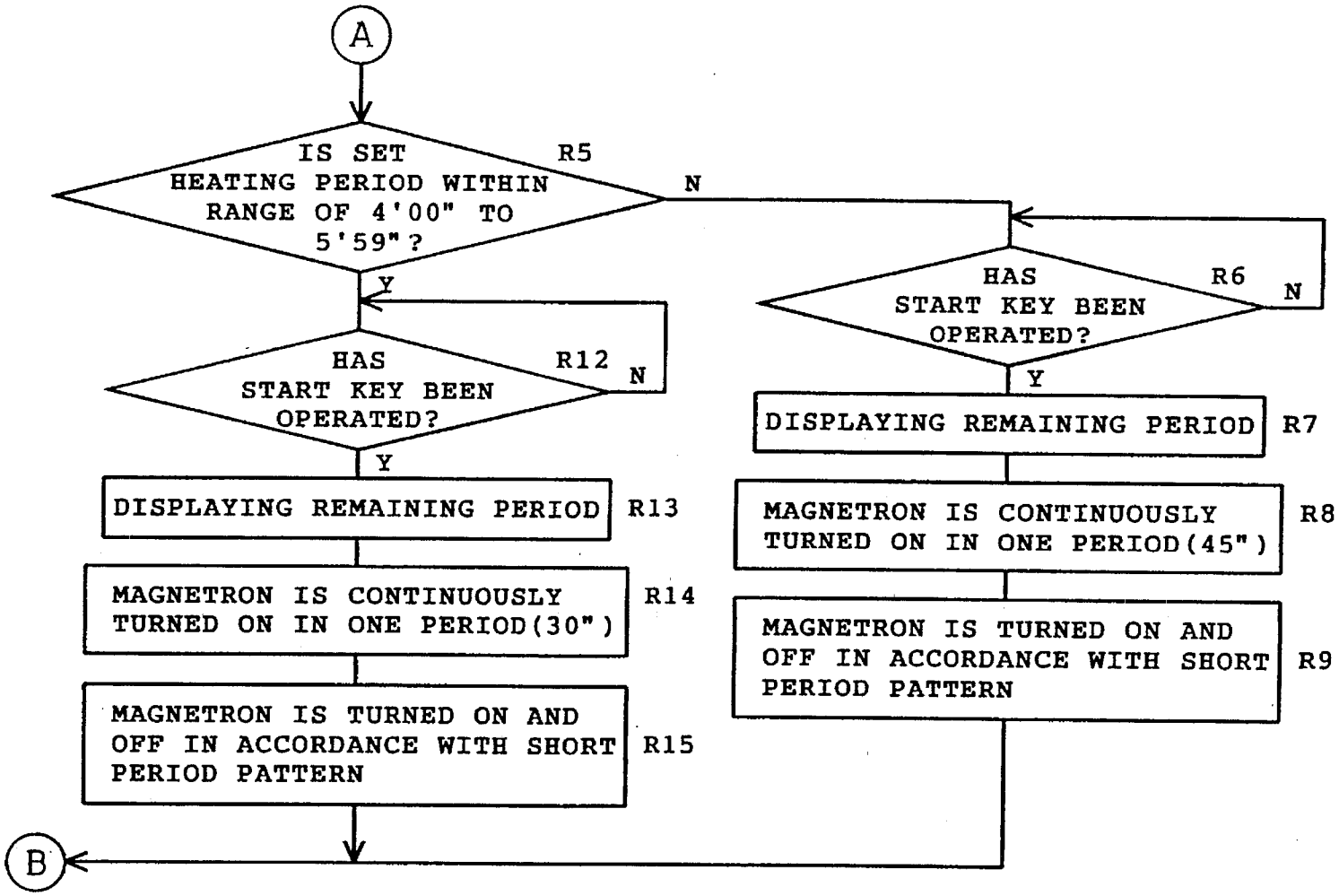

FIGS. 11A to 15 illustrate a fourth embodiment of the present invention. In the fourth embodiment, the short period pattern has a predetermined number of initial cycles in which the magnetron 27 is continuously energized. As shown in FIG. 11A, the detected value of weight is input at step R1 and the doneness setting is input at step R2. The heating period set by the user is input at step R3. At step R4, the control circuit 29 determines as to whether or not the set heating period is in the range of 0 to 3 minutes and 59 seconds. Furthermore, the control circuit 29 determines as to whether or not the heating period is in the range of 4 minutes to 5 minutes and 59 seconds and further determines as to whether or not the heating period has exceeded the latter range, at step R5 in FIG. 11B.

Figure 12P:
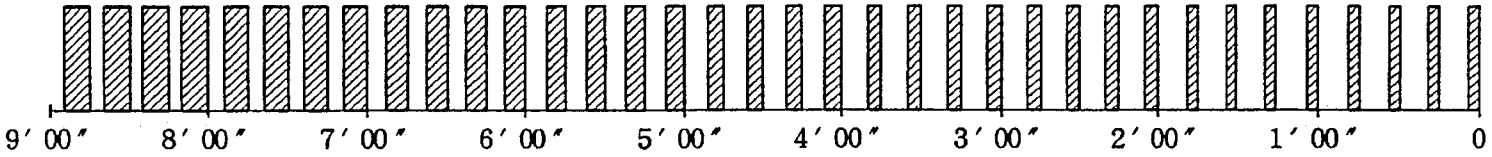
FIG. 12 is a graph showing a typical short period pattern employed in the fourth embodiment of a microwave oven.

The remaining period is displayed at step R7 when the set heating period has exceeded the range of 4 minutes to 5 minutes and 59 seconds at step R5 and the start hey 6c has been operated at step R6. The magnetron 27 is continuously energized for the predetermined initial period corresponding to first three cycles of the short period pattern wherein one period is 15 seconds, at step R7. Subsequently, the period corresponding to the three cycles or 45 seconds is subtracted from the set heating period so that a remaining period is obtained. The magnetron 27 is on-off controlled in accordance with the short period pattern Pz as shown in FIG. 12 for the remaining period. Thereafter, the control circuit 29 advances to steps R10 and R11 in turn.

Figures 13A, 13B:
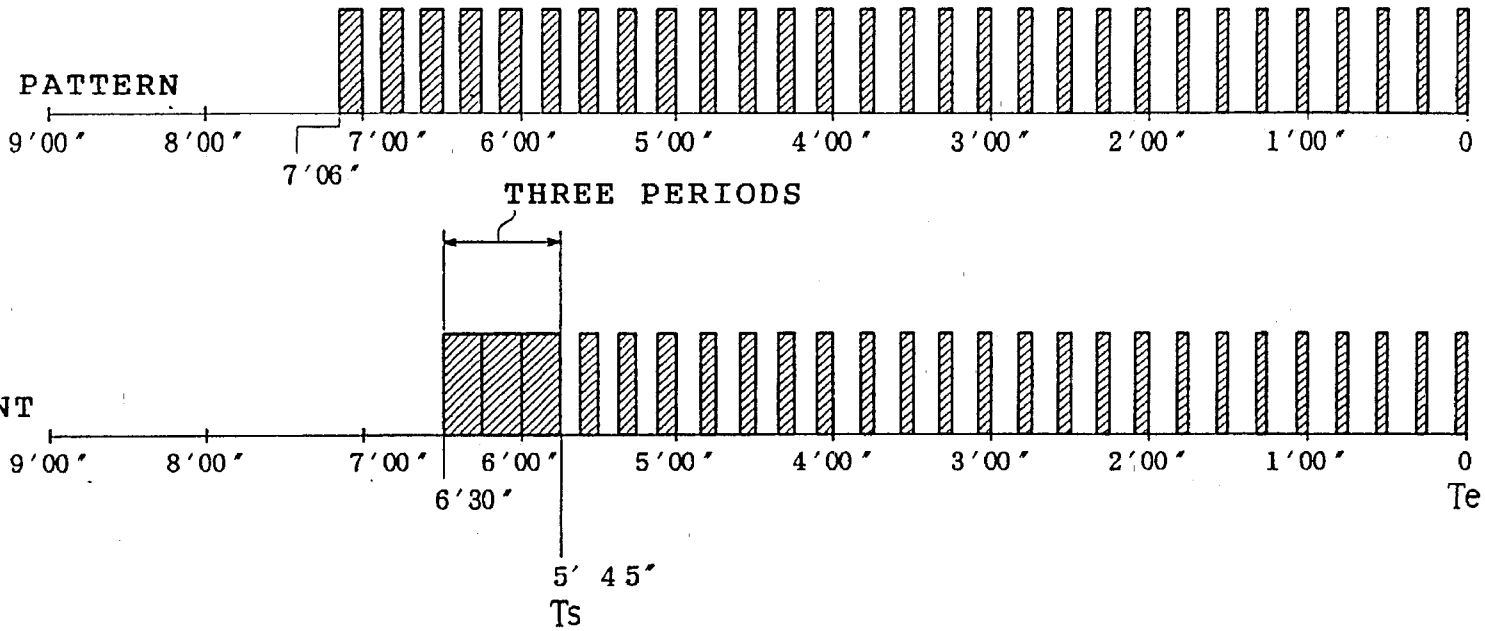
FIGS. 13A and 13B are graphs showing on-off control patterns for the magnetron in the case where one type of food is heated.
Figure 15:
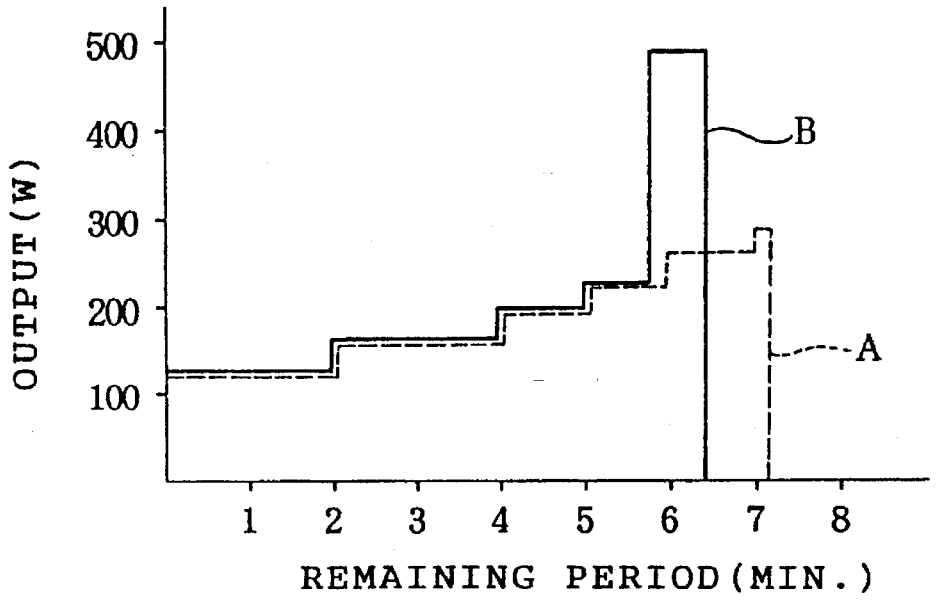
FIG. 15 is a graph showing the changes in the output of the magnetron in the case where said one type of food is heated.

FIG. 13B shows an on-off control pattern when the heating period is set at 6 minutes and 30 seconds, for example. In this on-off control pattern, the magnetron 27 is continuously energized for three cycles initiating at the start of the heating. Subsequently, the magnetron 27 is controlled in accordance with the short period pattern Pz. On the other hand, FIG. 13A shows a contrastive pattern wherein the continuous on period is not provided. As obvious from the comparison of these two patterns, the required heating period in the case of FIG. 13B is shorter than that in the case of FIG. 13A when a total drive period of the magnetron 27 is the same or 162 seconds. Broken line A in FIG. 15 shows the variations of the output of the magnetron obtained by the pattern of FIG. 13A while solid line B in FIG. 15 shows those of the magnetron output obtained by the pattern of FIG. 13B.

Figures 14A, 14B:
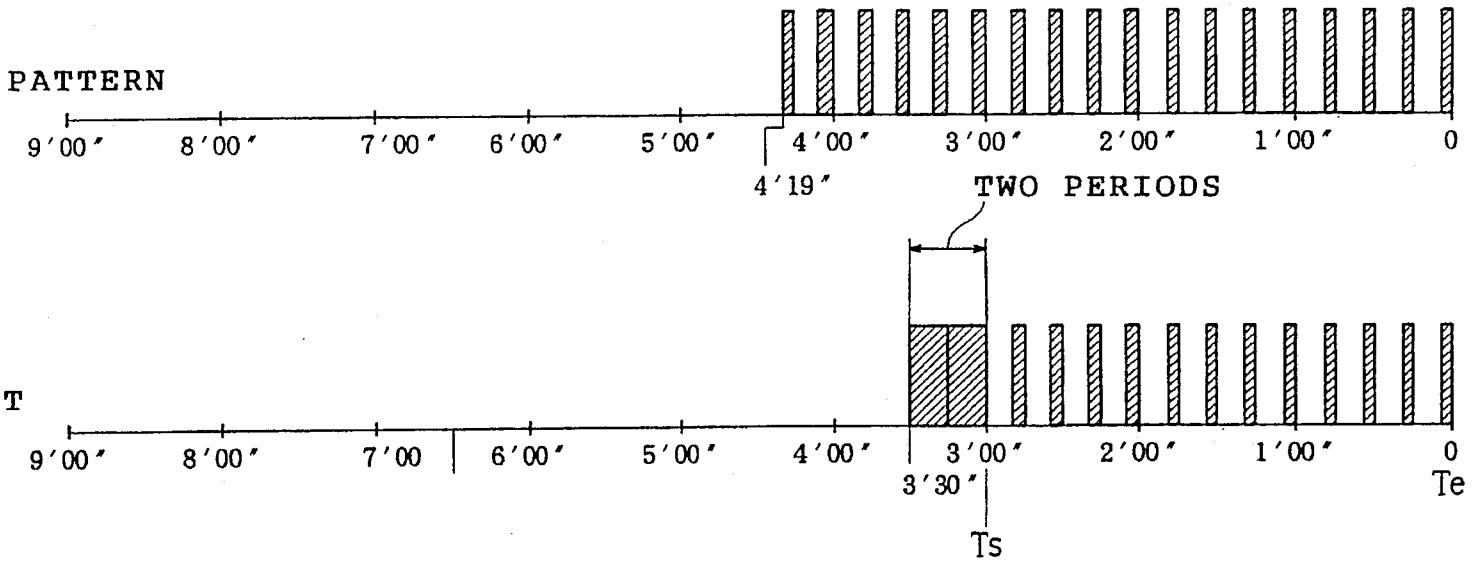
FIGS. 14A and 14B are graphs showing on-off control patterns for the magnetron in the case where another type of food is heated.
Figure 16:
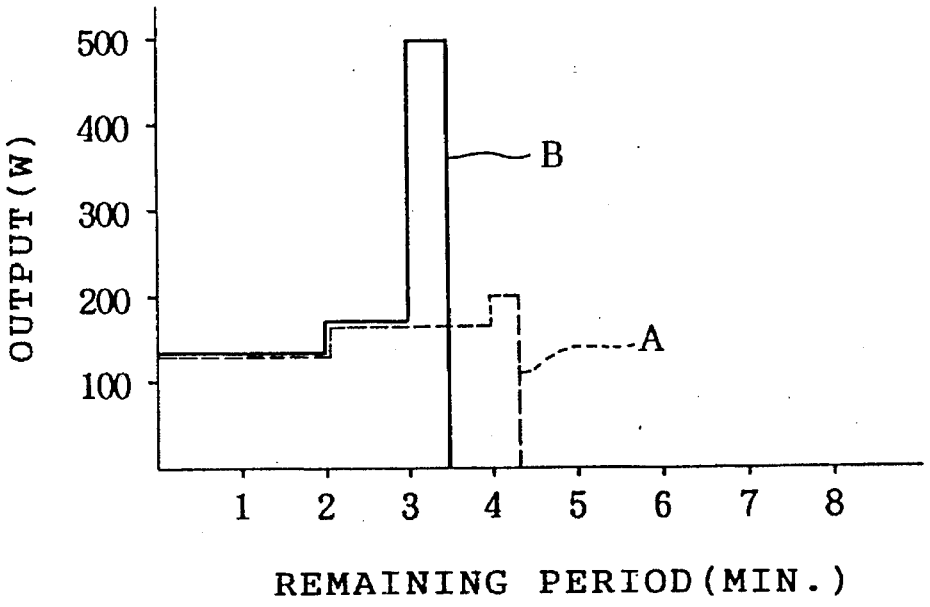
FIG. 16 is a graph showing the changes in the output of the magnetron in the case where said other type of food is heated.

When the set heating period is within the range of 4 minutes to 5 minutes and 59 seconds (step R5), the remaining period is displayed (step R13) upon depression of the start key 6c (step R12). The magnetron 27 is continuously energized for the predetermined initial period corresponding to first two cycles of the short period pattern wherein one period is 15 seconds, at step R14. Subsequently, the period corresponding to the two cycles or 30 seconds is subtracted from the set heating period so that a remaining period is obtained. The magnetron 27 is on-off controlled in accordance with the short period pattern Pz as shown in FIG. 12 for the remaining period. FIG. 14B shows an on-off control pattern when the magnetron 27 is controlled in the above-described manner. For example, when the heating period is set at 3 minutes and 30 seconds, a total drive period of the magnetron 27 is 82 seconds. FIG. 14A shows a contrastive pattern without the continuous on period. In this pattern, the heating period needs to be set at 4 minutes and 19 seconds in order that the total drive period of 82 seconds is obtained. The heating period is thus shortened in the embodiment, too. Broken line A in FIG. 16 shows the variations of the output of the magnetron obtained by the pattern of FIG. 14A while solid line B in FIG. 16 shows those of the magnetron output obtained by the pattern of FIG. 14B.

When the set heating period is within the range of 0 seconds to 3 minutes and 59 seconds (step R4), the magnetron 27 is continuously energized for a period corresponding to first one cycle of the short period pattern, as obvious from step R18.

According to the fourth embodiment, the magnetron is continuously energized for the predetermined cycles of the short period pattern when the same is selected. Consequently, the heating period can be shortened. Since the magnetron is continuously energized only for the predetermined cycles initiating at start of the heating, the unevenness in the heating does not occur.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

I claim:

1. A microwave oven comprising:

a) a magnetron for delivering microwave for heating frozen food;

b) control means electrically connected to the magnetron for controlling operation of the magnetron;

c) condition input means electrically connected to the control means for inputting conditioning data for conditioning a heating control to the control means;

d) storage means electrically connected to the control means storing data of two kinds of on-off patterns for on-off controlling the magnetron, either of the two kinds of on-off patterns being selected for a single thawing step executed during a period from a start to a completion of a thawing operation, one of the two kinds of on-off patterns being a long period pattern wherein each one period which is a total of an on-time and an off-time is relatively long, the other kind of on-off pattern being a short period pattern wherein each one period which is a total of the on-time and the off-time is shorter than that of the long period pattern; and e) selecting means electrically connected to the control means for selecting one of the kinds of on-off patterns for the control means to use for controlling the magnetron, the selecting means selecting the short period pattern when the conditioning data input from the condition input means to the control means indicates that unevenness in the heating tends to occur in the frozen food so that the control means controls the magnetron in accordance with the selected short period pattern, the selecting means otherwise selecting the long period pattern so that the control means controls the magnetron in accordance with the selected long period pattern.

2. A microwave oven according to claim 1, wherein the condition input means comprises food weight specifying means for specifying the weight of the frozen food, and wherein the selecting means selects short period pattern when the weight of the frozen food specified by the food weight specifying means is at a predetermined value or below.

3. A microwave oven according to claim 2, wherein the food weight specifying means comprises weight detecting means for detecting the weight of the frozen food.

4. A microwave oven according to claim 1, wherein the condition input means comprises heating degree designating means for designating a degree of strength of the heating for the frozen food among modes at least including an INTENSE mode after the frozen food has been thawed, and wherein the selecting means selects the short period pattern when the INTENSE mode has been designated by the heating degree designating means.

5. A microwave oven according to claim 1, wherein the condition input means comprises food type specifying means for specifying a type of the frozen food, and wherein the selecting means selects from among the kinds of on-off patterns in accordance with the type of the frozen food specified by the food type specifying means.

6. A microwave oven according to claim 5, wherein the selecting means selects the short period pattern when the frozen food has been designated as meat by the food type specifying means.

7. A microwave oven according to claim 1, wherein the condition input means comprises food weight specifying means for specifying a weight of the frozen food and heating degree designating means for designating a degree of strength of the heating for the frozen food among modes at least including an INTENSE mode after the frozen food has been thawed, and wherein the selecting means selects the short period pattern when the weight of the frozen food specified by the food weight specifying means is at a predetermined value or below and, at the same time, when the INTENSE mode has been designated by the heating degree designating means.

8. A microwave oven according to claim 1, wherein the condition input means comprises heating period specifying means for specifying a heating period for the frozen food, and wherein the selecting means selects the short period pattern when the heating period specified by the heating period specifying means is at a predetermined value or below.

9. A microwave oven according to claim 1, wherein each one period of the short period pattern has the length of time equal to one n-th of each one period of the long period pattern where n is an integer.

10. A microwave oven according to claim 1, wherein the short period pattern includes at least an initial one cycle of a continuous on mode.

11. A microwave oven comprising:

a) a magnetron for delivering microwave for heating frozen food;

b) a controller electrically connected to the magnetron for controlling operation of the magnetron;

c) a condition inputter electrically connected to the controller for inputting conditioning data for conditioning a heating control to the controller;

d) a storage device electrically connected to the controller storing data of two kinds of on-off patterns for on-off controlling the magnetron, either of the two kinds of on-off patterns being selected for a single thawing step executed during a period from a start to a completion of a thawing operation, one of the two kinds of on-off patterns being a long period pattern wherein each one period which is a total of an on-time and an off-time is relatively long, the other kind of on-off pattern being a short period pattern wherein each one period which is a total of the on-time and the off-time is shorter than that of the long period pattern; and e) a selector electrically connected to the controller for selecting one of the kinds of on-off patterns for the controller to use for controlling the magnetron, the selector selecting the short period pattern when the conditioning data input from the condition inputter to the controller indicates that unevenness in the heating tends to occur in the frozen food so that the controller controls the magnetron in accordance with the selected short period pattern, the selector otherwise selecting the long period pattern so that the controller controls the magnetron in accordance with the selected long period pattern.

* * * * *